US005168694A

United States Patent [19]

Raasch et al.

[11] Patent Number: 5,168,694

[45] Date of Patent: Dec. 8, 1992

[54] METHOD AND APPARATUS FOR DRIVING DRAFTING ROLLERS DURING THREAD-UP

[75] Inventors: Hans Raasch; Günter Frehn, both of Monchen-Gladbach, Fed. Rep. of Germany

[73] Assignee: W. Schlafhorst AG & Co., Monchen-Gladbach, Fed. Rep. of Germany

[21] Appl. No.: 528,138

[22] Filed: May 23, 1990

[30] Foreign Application Priority Data

May 25, 1989 [DE] Fed. Rep. of Germany ..... 3917047

[51] Int. Cl.[5] ..... D01H 13/02; D01H 5/18

[52] U.S. Cl. ..... 57/84; 57/279

[58] Field of Search ..... 57/90, 91, 83, 84, 279, 57/280, 317, 261, 263, 279; 226/181, 186, 187; 19/258, 259, 268, 293, 281, 283, 260, 261

[56] References Cited

U.S. PATENT DOCUMENTS

| | | | |
|---|---|---|---|
| 1,794,578 | 3/1931 | Broch | 19/260 |
| 4,089,155 | 5/1978 | Stahlecker | 57/279 X |
| 4,127,983 | 12/1978 | Munker | 57/279 |
| 4,187,588 | 2/1980 | Tsukumo | 19/281 |
| 4,356,691 | 11/1982 | Karl et al. | 57/279 X |
| 4,365,465 | 12/1982 | Müller et al. | 57/84 |
| 4,550,560 | 11/1985 | Tanaka et al. | 57/279 X |
| 4,704,857 | 11/1987 | Stahlecker | 57/264 |

FOREIGN PATENT DOCUMENTS

| | | | |
|---|---|---|---|
| 3543572 | 6/1987 | Fed. Rep. of Germany . | |
| 271920 | 2/1930 | Italy | 19/258 |
| 647562 | 1/1985 | Switzerland . | |
| 296100 | 4/1929 | United Kingdom | 19/293 |

*Primary Examiner*—Daniel P. Stodola
*Assistant Examiner*—John Rollins
*Attorney, Agent, or Firm*—Herbert L. Lerner; Laurence A. Greenberg

[57] ABSTRACT

A spinning machine includes a yarn draw-off apparatus having a pair of rollers including a draw-off roller being continuously rotatable in a draw-off direction and a shiftable contact roller to be pressed against the draw-off roller for clamping a spun yarn in a gap between the rollers and transporting the yarn. A method and apparatus for drawing-off a yarn produced in the spinning machine include driving the contact roller at a predeterminable circumferential speed prior to beginning drawing-off yarn while the gap between the rollers is open, before pressing the contact roller against the draw-off roller for drawing-off the yarn and closing the gap between the rollers.

13 Claims, 1 Drawing Sheet

METHOD AND APPARATUS FOR DRIVING DRAFTING ROLLERS DURING THREAD-UP

The invention relates to a method and apparatus for drawing-off, unwinding or delivering yarn produced in a spinning machine with a yarn draw-off apparatus being formed of a pair of rollers including a draw-off roller being continuously rotatable in a draw-off direction and a shiftable contact roller to be pressed against the draw-off roller for clamping a spun yarn in a gap between the rollers and transporting the yarn.

Yarn draw-off apparatus are used, for instance, in open-end rotor spinning machines or other types of open-end spinning machines.

After being pieced, the yarn is fed from one side into a open gap between rollers, for instance with the contact roller disengaged. The contact roller is then pressed against the draw-off roller, in the process of which the yarn is clamped between the draw-off roller and the contact roller and is continuously drawn-off from the actual spinning element at a constant draw-off speed.

In order to enable the contact roller to press against the draw-off roller while oriented parallel under all conditions, its bearing may be constructed in such a way that it can swing back and forth somewhat, and tolerances in the parallel positioning can be compensated for. The angle of swing is limited to the order of magnitude of one degree.

After the contact roller is lifted away or disengaged, it is no longer driven by the draw-off roller and comes to a s&op. When the contact roller is placed against the draw-off roller again, it must first be accelerated to the circumferential speed of the draw-off roller by friction. The acceleration period is quite short, but nevertheless the yarn is drawn-off during the acceleration period at a draw-off speed that is slower than normal. In that process it is also subjected to increased friction. That can lead to yarn flaws or breakage of the yarn.

It is accordingly an object of the invention to provide a method for drawing-off a yarn produced in a spinning machine and a yarn draw-off apparatus for performing the method, which overcome the hereinafore-mentioned disadvantages of the heretofore-known methods and devices of this general type and which create conditions conducive to an effective, relatively problem-free onset of the yarn draw-off.

With the foregoing and other objects in view there is provided, in accordance with the invention, a method for drawing-off a yarn produced in a spinning machine with a yarn draw-off apparatus, the yarn draw-off apparatus having a pair of rollers including a draw-off roller being continuously rotatable in a draw-off direction and a shiftable contact roller to be pressed against the draw-off roller for clamping a spun yarn in a gap between the rollers and transporting the yarn, which comprises driving the contact roller at a predeterminable circumferential speed prior to beginning drawing-off yarn while the gap between the rollers is open, before pressing the contact roller against the draw-off roller for drawing-off the yarn and closing the gap between the rollers.

The contact roller lifted away from the draw-off roller can accordingly be driven at the same circumferential speed as the draw-off roller even before the gap between rollers is closed. If the gap between rollers is then closed after feeding the yarn into it upon the occurrence of a startup procedure, then the yarn draw-off takes place immediately at normal draw-off speed, without any relative motion between the surfaces of the rollers of the pair and without chafing forces being exerted upon the yarn.

In accordance with another mode of the invention, there is provided a method which comprises maintaining rotation of the contact roller upon opening the gap between the rollers, and continuing to maintain rotation of the contact roller beyond a time during which the contact roller is again pressed against the draw-off roller for drawing-off yarn and closing the gap between the rollers.

With the objects of the invention in view, there is also provided a spinning machine having a pair of rollers including a draw-off roller being continuously rotatable in a yarn draw-off direction and a shiftable contact roller to be pressed against the draw-off roller for clamping a spun yarn in a gap between the rollers and transporting the yarn, a yarn draw-off apparatus, comprising a device for assuring rotation of the contact roller at a predeterminable circumferential speed while the gap between the rollers is open and the contact roller is not pressed against the draw-off roller for drawing-off yarn.

In accordance with another feature of the invention, the device is a gear mechanism shiftable between the draw-off roller and the contact roller.

In accordance with a further feature of the invention, the gear mechanism is a friction wheel gearing with one friction wheel to be pressed against the draw-off roller or its shaft, and another friction wheel to be pressed against the contact roller or its shaft.

In accordance with an added feature of the invention, the friction wheels are in frictional contact with one another, and the friction wheels have diameters in the same ratio to one another as the diameters of the draw-off roller or its shaft and the contact roller or its shaft. This accordingly assures the necessary equalization of circumferential speeds.

In accordance with an additional feature of the invention, the device is a component of a traveling unit engaging and disengaging the contact roller for a piecing procedure.

In open-end spinning machines it is known to provide such traveling units to perform the piecing. The same traveling units also engage and disengage the contact rollers of the various spinning stations as needed, so that it is economical to integrate the supplementary device into the traveling unit as well.

However, the supplementary device can also have other constructions according to the invention as follows.

In accordance with yet another feature of the invention, the contact roller is supported on a shaft, and the device includes a hinge joint carrying the shaft of the contact roller for pivoting the contact roller only in a pivot plane disposed substantially perpendicular to the yarn draw-off direction, and a torque device imparting a torque to the contact roller in the pivot plane.

In accordance with yet a further feature of the invention, the contact roller has a yarn feed side and an edge opposite the yarn feed side, and the contact roller is movable away from the draw-off roller into a disengaged position only far enough to maintain the edge of the contact roller in frictional contact with the draw-off roller while the gap between the rollers simultaneously has a wedge-shaped opening.

Such a configuration has the advantage of ensuring that the contact roller rotates continuously. This makes it possible to feed the yarn into the clamping rotation between the draw-off roller and the contact roller without interrupting the drive of the contact roller, or without having to accelerate the contact roller first as well, which under some conditions would cause a loss of time.

In accordance with a concomitant feature of the invention, there is provided a carrier for the hinge joint, the con&:act roller having an axis of rotation, the shaft of the contact roller having a surface disposed obliquely relative to &he axis of rotation of the contact roller, and the torque device being a compression spring pressed against the surface of the shaft of the contact roller and against the carrier.

Other features which are considered as characteristic for the invention are set forth in the appended claims.

Although the invention is illustrated and described herein as embodied in a method for drawing-off a yarn produced in a spinning machine and a yarn draw-off apparatus for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
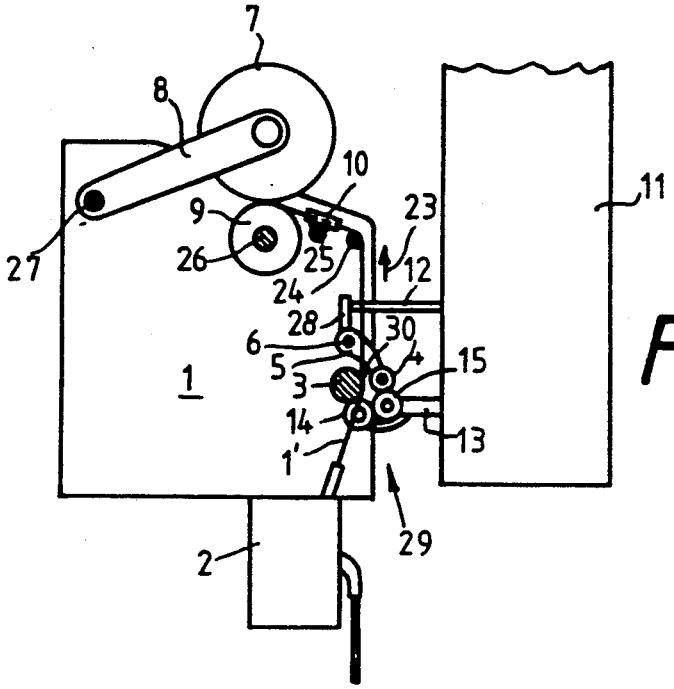
FIG. 1 is a fragmentary, diagrammatic, side-elevational view of a winding station of an open-end spinning machine.

Referring now to the figures of the drawing in detail and first, particularly, to FIG. 1 thereof, there is seen a traveling unit 11 which is parked in front of a spinning station 1. At the spinning station 1, a yarn or thread 1' is drawn out of a spinning box 2 during normal spinning operation, through a pair of rollers in the form of a draw-off roller 3 and a contact roller 4. The contact roller 4 can be pressed against the draw-off roller 3 and is only drivable by friction in a draw-off direction 23 by means of the draw-off roller 3, in a state in which it is pressed against the roller 3.

The contact roller 4 is rotatably supported on a two-armed lever 5. The two-armed lever 5 is pivotable about a bolt 6. A spiral spring, which is hidden by the lever 5 and therefore cannot be seen in FIG. 1, is wound about the bolt 6 and pivots the lever with the contact roller 4 against the draw-off roller 3. The draw-off roller 3 in this case is constructed as a continuous, centrally driven shaft that extends over all of the spinning stations of one side of the machine.

The yarn 1' travels past a yarn guide rod 24, a traversing yarn guide 10 and a winding drum 9 for a cross-wound bobbin 7 or cheese.

The traversing yarn guide 10 is actuated by a centrally driven traversing rod 25 which is guided along the side of the machine. The winding drum 9 is driven by a shaft 26, which is also guided along the side of the machine and is centrally driven. The cheese 7 is held by a creel 8. The cheese 7 rests on the winding drum 9 and is frictionally driven by the winding drum 9. In this process the creel 8 pivots upward about a pivot point 27 as the cheese 7 increases in size.

The traveling unit 11 is constructed as a mobile piecing device, which is capable of moving from one spinning station to another in order to perform piecing procedures. The traveling unit 11 has elements for picking up the yarn on the cheese 7, returning the yarn to the spinning box 2 and controlling the spinning procedure. These elements are generally known and are therefore not shown. The traveling unit 11 also has a controllable presser bar 12, which at the moment shown in the drawing is pressing against an indexing lug 28 of the lever 5, so that the contact roller 4 is disengaged, or in other words lifted away from the draw-off roller 3.

Another component of the traveling unit 11 is a device 29 which assures the rotation of the contact roller 4 when a gap 30 is opened between the rollers, and is capable of acting upon the contact roller 4 in the illustrated disengaged state of the contact roller 4.

The device 29 is formed of a gear mechanism that is shiftable between the draw-off roller 4 and the contact roller 3. The gear mechanism 29 in turn is formed of a friction wheel gearing having two friction wheels 14 and 15. The friction wheel 14 can be pressed against the draw-off roller 3 and the friction wheel 15 can be pressed against the disengaged contact roller 4, due to the fact that the gear mechanism 29 is located at the end of a shifter rod 13.

FIG. 1 shows that the shifter rod 13 has been moved outward, so that the two friction wheels 14, 15 that are in frictional contact with one another drive the contact roller 4 from the draw-off roller 3. The diameters of the friction wheels 14, 15 are in the same ratio to one another as the diameters of the draw-off roller 3 and contact roller 4, so that the contact roller 4 has the same circumferential speed as the draw-off roller 3.

In the relatively simple embodiment of FIG. 1, the yarn 1' is already being wound onto the cheese 7 with the gap 30 open between rollers, before the roller pair 3, 4 takes on the task of yarn draw-off.

In order to effect the yarn draw-off by means of the roller pair 3, 4, the traveling unit 11 automatically retracts the presser bar 12. This causes the lever 5 to pivot clockwise, so that the contact roller 4 presses against the yarn 1' and against the draw-off roller 3. Since both circumferential speeds are the same, the yarn draw-off begins with no opportunity for problems to arise. Subsequently, the traveling unit 11 also retracts the shifter bar 13, so that from then on the contact roller 4 is only directly frictionally driven by the draw-off roller 3.

The retraction of the presser bar 12 and the shifter bar 13 disengages the traveling unit 11 from the winding station 1, so that it can travel onward to some other working region of the spinning machine.

In order to ensure that the rotation of the contact roller 4 will not stop at all, it is possible for the traveling unit 11 to proceed as follows upon disengagement of the contact roller 4, or in other words upon the opening of the gap 30 between the rollers:

First, the traveling unit 11 pushes the shifter bar 13 forward, in order to place the friction wheels 14 and 15 in contact with the draw-off roller 3 and the contact roller 4, respectively. The traveling unit then pushes the presser bar 12 forward, in order to pivot the lever 5, as a result of which the gap 30 opens between the rollers.

FIG. 1 indicates that the friction wheel 14 is always located behind the plane of the travel of the yarn 1' as seen by a viewer. The yarn 1' travels in front of the front surface of the friction wheel 4 or, in other words, the yarn 1' is located closer to the viewer of FIG. 1 than the front surface of the wheel 4. The lever 5 and the presser bar 12 are also located behind the yarn travel plane.

Figure 3:
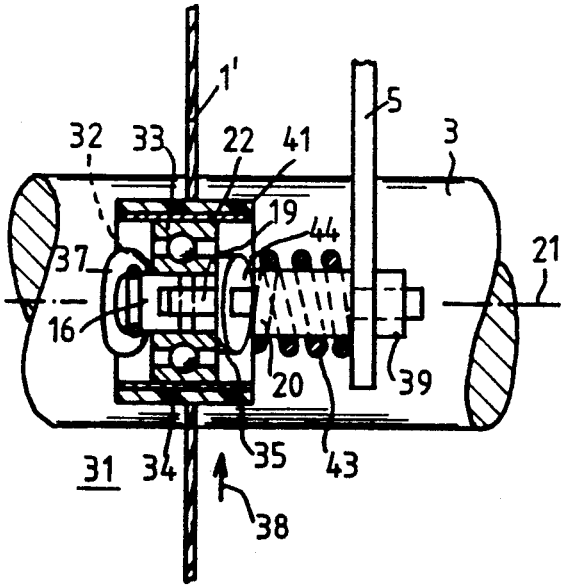
FIG. 3 is a view similar to FIG. 2 which is taken along a different sectional plane, showing the device during yarn draw-off.
Figure 2:
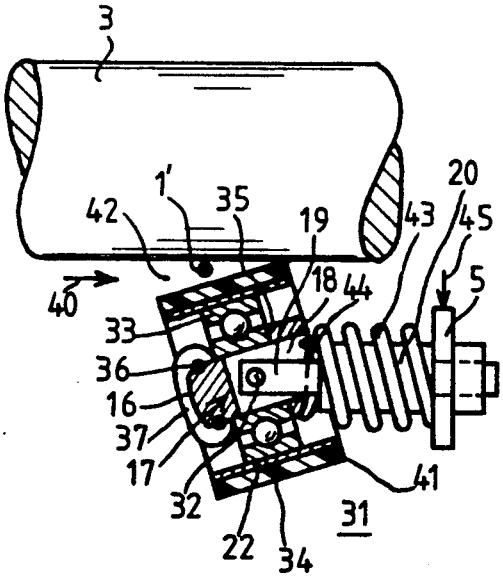
FIG. 2 is a fragmentary, enlarged, partly longitudinalsectional view of a device according to the invention.

A device 31 of the second exemplary embodiment is formed of the following configuration, as shown in FIGS. 2 and 3:

A shaft 16 has a hinge joint 17. The hinge joint 17 has a slit 18 machined into the shaft 16, into which a stub 19 of a hinge joint carrier 20 fits. A pin 32 passing through the axis of rotation 21 of a contact roller 22 forms a pivot point of the hinge joint 17. The contact roller 22 is rotatably supported on its shaft 16 by a roller bearing 33. The contact roller 22 is provided with a rubber-elastic jacket 34. The roller bearing 33 is pressed against a shoulder 35 of the shaft 16 and is secured against sliding off the shaft 16 by a securing ring 36 and a cap 37.

As FIGS. 2 and 3 show, the hinge joint 17 is disposed in such a way that the contact roller 22 is pivotable in only one plane, which extends approximately at right angles to the yarn travel or draw-off direction 38. As FIG. 3 shows, the axis of rotation 21 of the contact roller 22 is located in the same plane. In this exemplary embodiment, a screw connection 39 firmly connects the hinge joint carrier 20 to the lever 5, which is of the kind shown in FIG. 1. Thus the lever 5 is a fixed component of the hinge joint carrier 20.

Through the use of non-illustrated stops, the pivoting travel of the lever 5 is limited in such a way that in its disengaged position shown in FIG. 2, the contact roller 22 can be moved away from the draw-off roller 3 only far enough to permit its edge 41 opposite a yarn feed side 40 to remain in frictional contact with the draw-off roller 3, while a wedge-shaped gap opening gap 42 between rollers is simultaneously present.

In FIGS. 2 and 3 the device 31 is provided with a torque device, which is formed of a compression spring 43 having one end being pressed against a surface 44 of the shaft 16 that is oblique to the axis of rotation 21 of the contact roller 22 and another end being pressed against the hinge joint carrier 20, or rather its lever 5.

FIG. 3 shows the contact roller 22 during normal winding operation. Its jacket 34 makes a linear contact with the draw-off roller 3, and in this process clamps the yarn 1' in the roller gap and transports it continuously in the draw-off direction 38.

If the lever 5 of FIG. 2 is pivoted a few millimeters in the direction of an arrow 45, the compression spring 43 makes the oblique position of the contact roller 22 compulsory. Its edge 41 remains in frictional contact with the draw-off roller 3, so that the rotational motion of the contact roller 22 does not stop. However, the gap 42 between the rollers opens in the shape of a wedge, so that the yarn 1' can be fed into the gap 42 between the rollers from the direction of the yarn feed side 40. The yarn draw-off begins as soon as the lever 5 is pivoted back again counter to the direction of the arrow 45, during which process the yarn 1' is clamped in the gap 42 between the draw-off roller 3 and contact roller 22.

In an alternative embodiment, the lever 5 is pivoted somewhat farther in the direction of the arrow 45 upon disengagement f the contact roller 22, so that the contact roller is no longer in contact with the draw-off roller 3. After the yarn 1' has been fed into the gap 42 between the rollers, the lever is then pivoted back again counter to the direction of the arrow 45. The edge 41 is then the first to make frictional contact with the draw-off roller 3. As a result, the contact roller 22 begins to rotate even before the closure of the gap 42 between the rollers, and does so at the same circumferential speed as the draw-off roller 3.

In another alternative embodiment, the device that assures the rotation of the contact roller while the gap between rollers is opened, may be formed of an electric stepping motor or gear motor that can be switched on and off.

We claim:

1. Method for drawing-off a yarn produced in a spinning machine with a yarn draw-off apparatus, the yarn draw-off apparatus having a pair of rollers including a draw-off roller being continuously rotatable in a draw-off direction and a contact roller to be pressed against the draw-off roller for clamping a spun yarn in a gap between the rollers and transporting the yarn, which comprises driving the contact roller at a predeterminable circumferential speed while opening the gap between the rollers for allowing yarn to be inserted, closing the gap between the rollers and pressing the contact roller against the draw-off roller for drawing-off the yarn.

2. Method according to claim 1, which comprises maintaining rotation of the contact roller upon opening the gap between the rollers, and continuing to maintain rotation of the contact roller beyond a time during which the contact roller is again pressed against the draw-off roller for drawing-off yarn and closing the gap between the rollers.

3. In a spinning machine having a pair of rollers including a draw-off roller rotatably supported in the spinning machine and being continuously rotatable in a yarn draw-off direction, and a shiftable contact roller shiftably and rotatably supported in the spinning machine, the contact roller being shiftable between 9 first operable position whereby the contact roller is pressed against the draw-off roller for clamping a spun yarn in a gap between the rollers and transporting the spun yarn and a second open position, a yarn draw-off apparatus, comprising a means connected to and cooperating with the contact roller for assuring rotation of the contact roller at a predeterminable circumferential speed in the second position wherein the rollers do not clamp and draw off yarn.

4. Apparatus according to claim 3, wherein said device is a gear mechanism shiftable between the draw-off roller and the contact roller.

5. Apparatus according to claim 4, wherein said gear mechanism is a friction wheel gearing with one friction wheel to be pressed against the draw-off roller, and another friction wheel to be pressed against the contact roller.

6. Apparatus according to claim 5, wherein said friction wheels are in frictional contact with one another, and said friction wheels have diameters in the same ratio to one another as the diameters of the draw-off roller and the contact roller.

7. Apparatus according to claim 4, wherein the draw-off and contact rollers have shafts, and said gear mechanism is a friction wheel gearing with one friction wheel to be pressed against the draw-off roller shaft and another friction wheel to be pressed against the contact roller shaft.

8. Apparatus according to claim 7, wherein said friction wheels are in frictional contact with one another, and said friction wheels have diameters in the same ratio to one another as the diameters of the draw-off roller shaft and the contact roller shaft.

9. Apparatus according to claim 3, wherein said device is a component of a traveling unit for disengaging and engaging the contact roller for a piecing procedure.

10. Apparatus according to claim 3, wherein the contact roller is supported on a shaft, and said device includes:

a) a hinge joint supporting the shaft of the contact roller for pivoting the contact roller only in a pivot plane disposed substantially perpendicular to the yarn draw-off direction, and b) means for imparting a torque to the contact roller in the pivot plane.

11. Apparatus according to claim 10, wherein the contact roller has a yarn feed side and an edge opposite the yarn feed side, and the contact roller is movable away from the draw-off roller only far enough to maintain the edge of the contact roller in frictional contact with the draw-off roller while the gap between the rollers simultaneously has a wedge-shaped opening.

12. Apparatus according to claim 11, including a carrier for said hinge joint, the contact roller having an axis of rotation, the shaft of the contact roller having a surface disposed obliquely relative to the axis of rotation of the contact roller, and said torque imparting means being a compression spring pressed against the surface of the shaft of the contact roller and against said carrier.

13. Apparatus according to claim 10, including a carrier for said hinge joint, the contact roller having an axis of rotation, the shaft of the contact roller having a surface disposed obliquely relative to the axis of rotation of the contact roller, and said torque imparting means being a compression spring pressed against the surface of the shaft of the contact roller and against said carrier.

* * * * *